US011707928B2

(12) United States Patent
Sun

(10) Patent No.: US 11,707,928 B2
(45) Date of Patent: Jul. 25, 2023

(54) THERMAL TRANSMISSION TUBULAR MARKING

(71) Applicant: Chien-Jieh Sun, Keelung (TW)

(72) Inventor: Chien-Jieh Sun, Keelung (TW)

( * ) Notice: Subject to any disclaimer, the term of this patent is extended or adjusted under 35 U.S.C. 154(b) by 640 days.

(21) Appl. No.: 16/903,521

(22) Filed: Jun. 17, 2020

(65) Prior Publication Data

US 2021/0394507 A1 Dec. 23, 2021

(51) Int. Cl.
*B41F 16/00* (2006.01)
*B41F 23/00* (2006.01)
*B41F 13/193* (2006.01)

(52) U.S. Cl.
CPC ..... *B41F 16/0086* (2013.01); *B41F 16/006* (2013.01); *B41F 16/0026* (2013.01); *B41F 23/005* (2013.01); *B41F 23/007* (2013.01); *B41F 13/193* (2013.01); *B41P 2213/11* (2013.01); *B41P 2219/20* (2013.01); *B41P 2219/43* (2013.01); *B41P 2219/60* (2013.01)

(58) Field of Classification Search
CPC ..... B41F 16/0006; B41F 16/0026; B41F 16/006; B41F 16/0073; B41F 16/0086; B41F 17/14; B41F 17/18; B41F 17/20; B41F 17/22; B41F 13/193; B41F 23/005; B41F 23/007; B41F 33/0009; B41J 3/4073; B41J 3/40733; B41J 11/48; B41J 11/50; B41P 2213/11; B41P 2219/20; B41P 2219/43; B41P 2219/60
See application file for complete search history.

(56) References Cited

U.S. PATENT DOCUMENTS 6,982,739 B2 * 1/2006 Misawa ..... B41J 3/4073 347/220

OTHER PUBLICATIONS

English translation of CA3064474.*
English translation of KR101444789.*

* cited by examiner

*Primary Examiner* — Sonya M Sengupta
(74) *Attorney, Agent, or Firm* — Alan D. Kamrath; Karin L. Williams; Mayer & Williams PC

(57) ABSTRACT

A tube marking device includes a delivery unit having operating rollers for delivering a tube. A thermal press printing unit includes a first heating device and a press printing roller which are actuated by a first lift cylinder to move vertically. A first transmission printing sheet is mounted to a first rotary disc, carries a plurality of marks thereon, and is moved by an operating unit. Two adjacent marks are continuous to each other or have a spacing therebetween smaller than 50 cm. A control unit is electrically connected to the delivery unit, the thermal press printing unit, the first rotary disc, and the operating unit. The delivery unit and the operating unit respectively move the tube and the first transmission printing sheet. The thermal press printing unit transmissions the plurality of marks of the first transmission printing sheet onto an outer periphery of the tube.

8 Claims, 10 Drawing Sheets

THERMAL TRANSMISSION TUBULAR MARKING

BACKGROUND OF THE INVENTION

The present invention relates to a tube marking apparatus and, more particularly, to a tube marking apparatus for marking a tube to provide improved marking and anti-counterfeiting effects.

Conventional tubes can be used to deliver fluids, such as liquids and gases, and can be made of different materials, such as plastics and metal, while having various diameters. Tubes are generally produced by extrusion to form an elongated shape. To provide an anti-counterfeiting effect, marks (such as the trademark of the manufacturer or the specification of the tube) are printed on an outer periphery of a tube and are spaced from each other by suitable intervals. To increase the printing effect, two adjacent identical marks are printed on an elongated tube and are spaced from each other by a plurality of meters, such that a user can identify the source of the tube by the marks.

However, after purchasing an elongated tube, the user generally has to cut the elongated tube by suitable lengths, obtaining a plurality of shorter tubes. In a case that the length of each shorter tube is shorter than the spacing between two adjacent marks of the elongated tube, some of the shorter tubes might have no marks thereon, leading to the risk of anti-counterfeiting. If the spacing between two adjacent marks is reduced to avoid anti-counterfeiting, the economic benefit is not good, because the printing efficiency is low.

BRIEF SUMMARY OF THE INVENTION

An objective of the present invention is to provide a tube marking apparatus for densely printing marks on an outer periphery of a tube, providing improved marking and anti-counterfeiting effects.

A tube marking device according to the present invention includes a delivery unit including a plurality of supporting rollers and a plurality of operating rollers configured to deliver a tube. A thermal press printing unit is mounted above the delivery unit and includes a first lift cylinder, a first heating device, and a press printing roller. The first heating device and the press printing roller are actuated by the first lift cylinder to move in a vertical direction. A guiding unit includes a first rotary disc and a plurality of guiding rods. A first transmission printing sheet is mounted to the first rotary disc and carries a plurality of marks thereon. Two adjacent marks are continuous to each other or have a spacing therebetween smaller than 50 cm. The first transmission printing sheet is moved by an operating unit. A control unit is electrically connected to the delivery unit, the thermal press printing unit, the guiding unit, and the operating unit. The delivery unit and the operating unit respectively move the tube and the first transmission printing sheet. The thermal press printing unit transmission the plurality of marks of the first transmission printing sheet onto an outer periphery of the tube.

In an example, the plurality of supporting rollers of the delivery unit is coplanarly disposed for supporting the tube. The plurality of operating rollers is arranged in pairs and is disposed above and spaced from the plurality of supporting rollers. Each pair of operating rollers is provided with an adjusting rod to adjust a spacing therebetween. The delivery unit includes a transmission device having a motor and a transmission rod coupled with the motor and the plurality of operating rollers. The motor drives the transmission rod and the plurality of operating rollers to rotate and to move the tube.

In an example, the thermal press printing unit further includes a preheating device and a transmission device for rotating the press printing roller. The preheating device preheats the tube and is mounted above the plurality of supporting rollers. The preheating device includes a second lift cylinder and a second heating device movable by the second lift cylinder.

In an example, the guiding unit further includes a second disc. A second transmission printing sheet with a plurality of marks is mounted to the second disc. Two adjacent marks on the second transmission printing sheet are continuous to each other or have a spacing therebetween smaller than 50 cm. The first disc includes a first shaft connected to a transmission device. The second disc includes a second shaft connected to another transmission device.

In an example, the operating unit includes a transmission device, an operating rod, a pressing rod, and a recycling rod. The transmission device of the operating unit rotates the operating rod. The pressing rod is mounted to a side of the operating rod. The first transmission printing sheet is clamped between the operating rod and the pressing rod. The recycling rod interlocks with the operating rod and is coupled to an end of the first transmission printing sheet.

In an example, an adjusting unit is mounted to an input side of the operating unit and includes an adjusting seat, two guiding posts, two vertical columns, an adjusting block, an upper switch, and a lower switch. The adjusting seat includes a sidewall, an upper wall, and a lower wall. The adjusting seat further includes a hollow portion at a central portion thereof. The two guiding posts are disposed on two sides of an upper end of the adjusting seat and respectively press against and guide the first transmission printing sheet. The two vertical columns are mounted between the upper wall and the lower wall. Each of two sides of the adjusting block includes a through-hole through which one of the two vertical columns extends. The adjusting block further includes a horizontal rod located at a central portion thereof and abutting against the first transmission printing sheet. The first transmission printing sheet is wound around a lower edge of the horizontal rod. The adjusting block is movable on the two vertical columns in the vertical direction and includes a touch rod configured to selectively abut against one of the upper switch and the lower switch. The upper switch and the lower switch are respectively disposed to upper and lower portions of the adjusting seat and are electrically connected to the transmission device of the operating unit. The operating rod rotates at a first rotating speed slightly faster than a second rotating speed of the plurality of operating rollers of the delivery unit.

In an example, a sheet changing unit mounted to a side of the first and second discs. The sheet changing unit includes a sheet changing seat, a lower horizontal beam, an upper horizontal beam, an actuation cylinder, a first sensor, and a second sensor. The lower horizontal beam is mounted below the sheet changing seat. The upper horizontal beam is mounted above and aligned with the lower horizontal beam. The actuation cylinder is mounted above the sheet changing seat and is configured to move the upper horizontal beam in the vertical direction. The first and second sensors are disposed in association with the first and second discs, respectively, are electrically connected to the actuation cylinder, and are configured to detect whether the first and second transmission printing sheets are about to run out.

In an example, the first transmission printing sheet extends between the upper and lower horizontal beams and is guided by the guiding member to the thermal press printing unit. The second transmission printing sheet includes an end bonded to the lower horizontal beam by a glue with a relatively smaller bonding force. Another glue with a relatively larger bonding force is applied to an upper side of the end of the second transmission printing sheet.

The present invention will become clearer in light of the following detailed description of illustrative embodiments of this invention described in connection with the drawings.

DETAILED DESCRIPTION OF THE INVENTION

Figure 1:
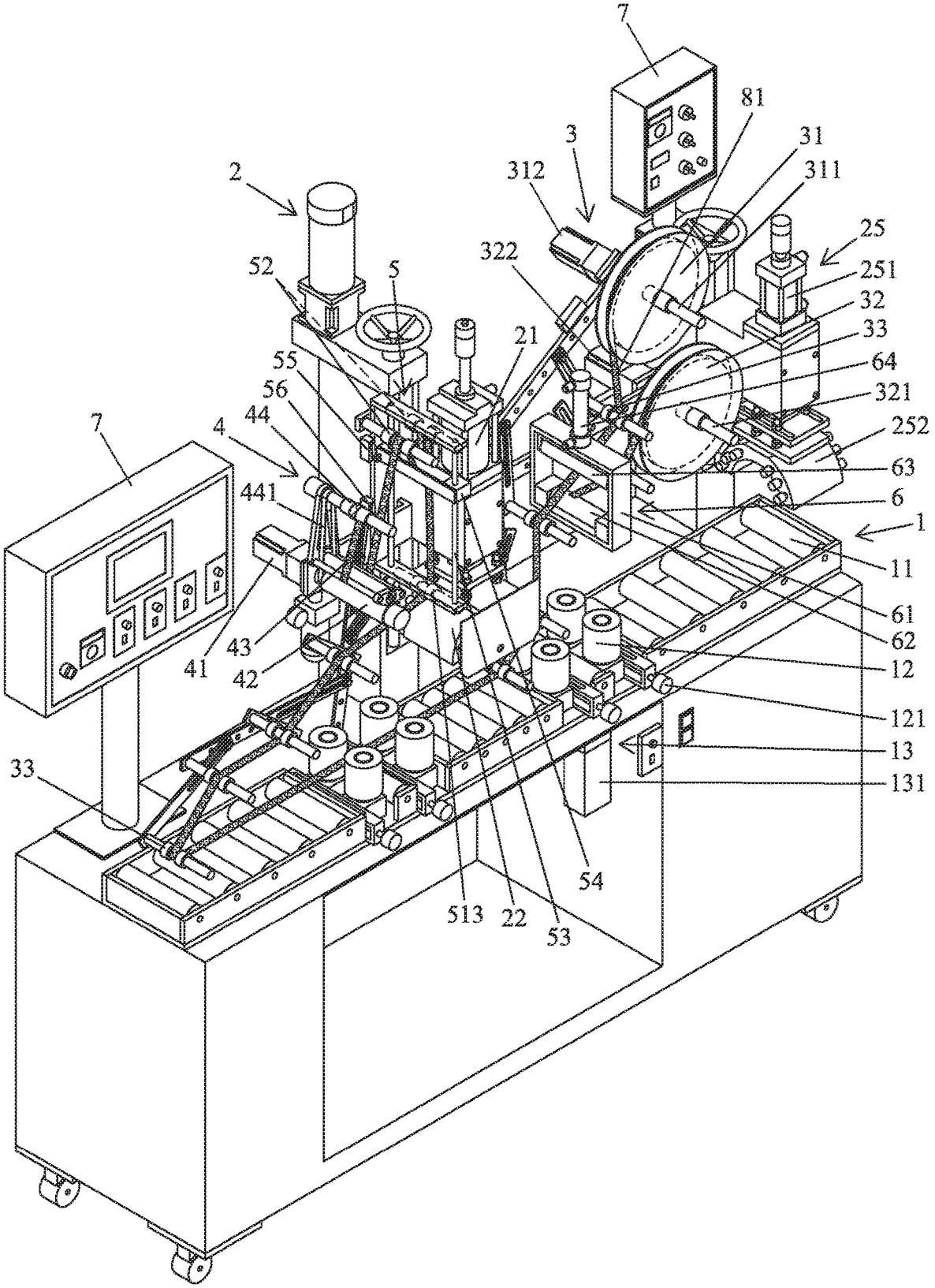
FIG. 1 is a diagrammatic perspective view of a tube marking apparatus of an embodiment according to the present invention.
Figure 2:
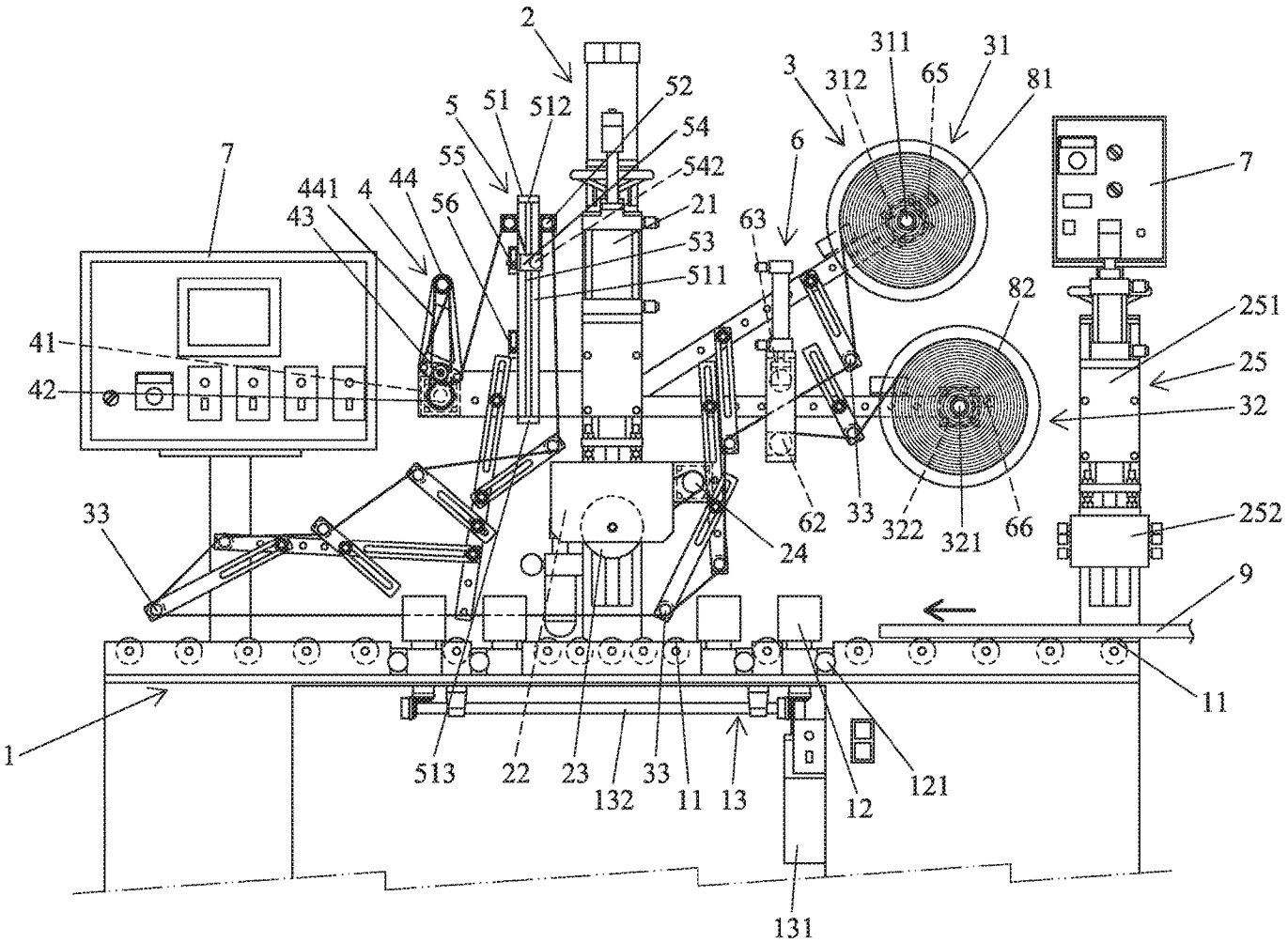
FIG. 2 is a diagrammatic elevational view of the tube marking apparatus of FIG. 1.
Figure 3:
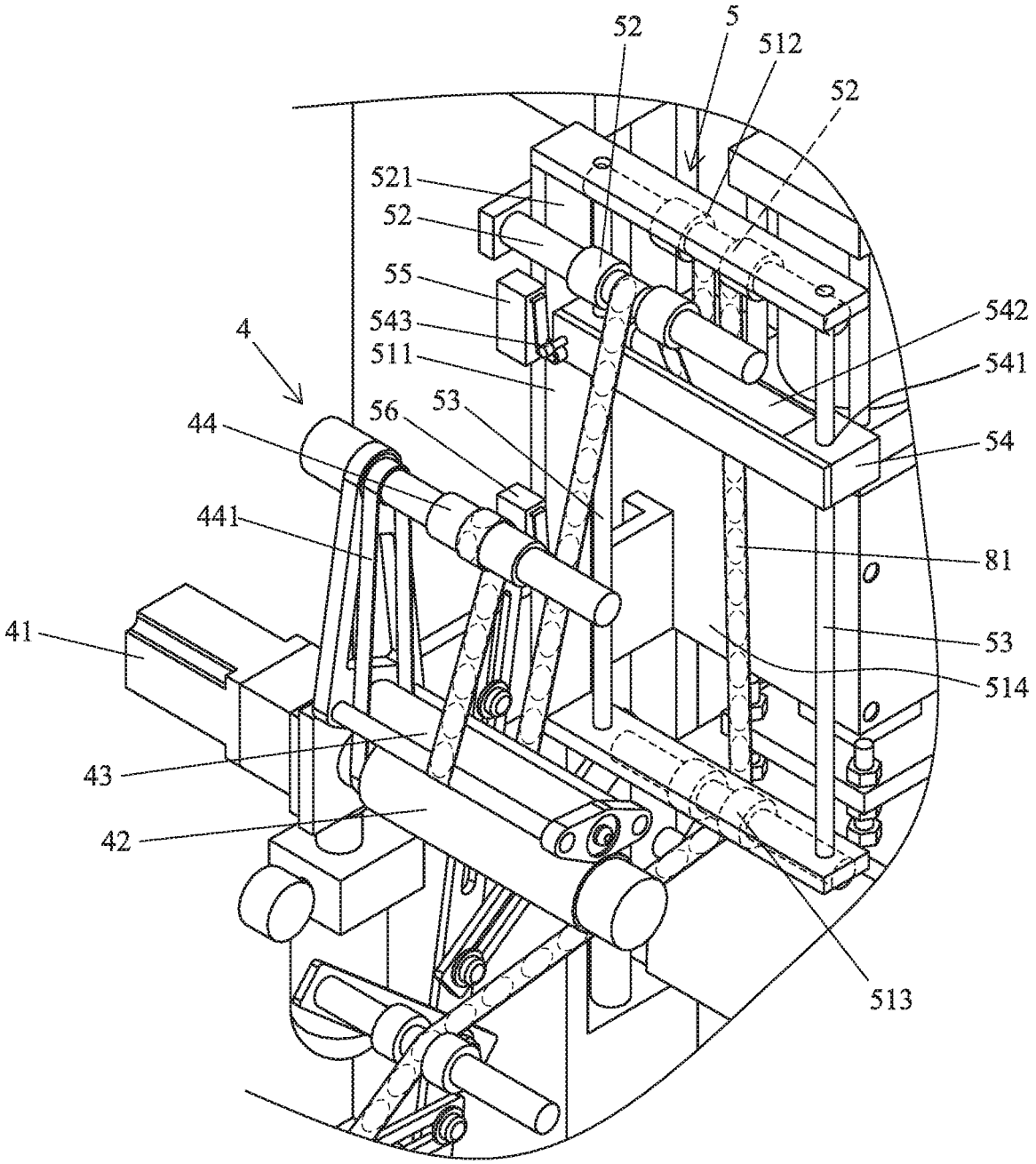
FIG. 3 is an enlarged, perspective view of a portion of the tube marking apparatus of FIG. 1.

With reference to FIGS. 1-4, a tube marking apparatus of an embodiment according to the present invention includes a delivery unit 1, a thermal press printing unit 2, a guiding unit 3, an operating unit 4, an adjusting unit 5, a sheet changing seat 6, and a control unit 7. The delivery unit 1 includes a plurality of supporting rollers 11, a plurality of operating rollers 12, and a transmission device 13. The plurality of supporting rollers 11 is coplanarly disposed from an input side to an output side of the delivery unit 1 for supporting a tube 9. The plurality of operating rollers 12 is arranged in pairs and is disposed above and spaced from the plurality of supporting rollers 11. Each pair of operating rollers 12 is provided with an adjusting rod 121 to adjust a spacing therebetween. The transmission device 13 includes a motor 131 and a transmission rod 132 coupled with the motor 131 and the plurality of operating rollers 12. The motor 131 drives the transmission rod 132 and the plurality of operating rollers 12 to rotate and to move the tube 9.

The thermal press printing unit 2 is mounted above the delivery unit 1 and includes a first lift cylinder 21, a first heating device 22, a press printing roller 23, a transmission device 24, and a preheating device 25. The first heating device 22 and the press printing roller 23 are actuated by the first lift cylinder 21 to move in a vertical direction to a higher position or a lower position relative to the plurality of supporting rollers 11. The first heating device 22 can be an electric heating cover. The transmission device 24 drives the press printing roller 23 to rotate at a rotating speed approximately equal to a rotating speed of the plurality of operating roller 12. The preheating device 25 is mounted to the input side of the delivery unit 1 and is located above the plurality of supporting rollers 11. The preheating device 25 includes a second lift cylinder 251 and a second heating device 252 movable by the second lift cylinder 251 to a higher position or a lower position relative to the plurality of supporting rollers 11. The second heating device 252 can be an electric heating cover.

The guiding unit 3 includes a first rotary disc 31, a second rotary disc 32, and a plurality of guiding rods 33. A first transmission printing sheet 811 is coiled to be mounted to the first rotary disc 31 and carries a plurality of marks 81 thereon. A second transmission printing sheet 82 is coiled to be mounted to the second rotary disc 32 and carries a plurality of marks 821 thereon. Two adjacent marks 811 on the first transmission printing sheet 81 are continuous to each other or have a spacing therebetween smaller than 50 cm. Likewise, two adjacent marks 821 on the second transmission printing sheet 82 are continuous to each other or have a spacing therebetween smaller than 50 cm. The first disc 31 includes a first shaft 311 connected to a transmission device 312 for providing a torque to the first shaft 311. The second disc 32 includes a second shaft 321 connected to another transmission device 322 for providing a torque to the second shaft 321. The plurality of guiding rods 33 can bend and guide the first and second transmission printing sheet 81 and 82 to the desired locations.

The operating unit 4 includes a transmission device 41, an operating rod 42, a pressing rod 43, and a recycling rod 44. The transmission device 41 can be a motor for rotating the operating rod 42. The pressing rod 43 is mounted to a side of the operating rod 42. The first transmission printing sheet 81 is clamped between the operating rod 42 and the pressing rod 43 and can be moved by the operating rod 42 and the pressing rod 43. The operating rod 42 rotates at a first rotating speed slightly faster than a second rotating speed of the plurality of operating rollers 12 of the delivery unit 1. The recycling rod 44 is mounted above the pressing rod 43 and is coupled with an end of the first transmission printing sheet 81. Furthermore, the recycling rod 44 interlocks with the operating rod 42 via a transmission belt 441. Thus, the first transmission printing sheet 81 can be wound around the recycling rod 44 after transmission printing.

The adjusting unit 5 is mounted to an input side of the operating unit 4 and includes an adjusting seat 51, two guiding posts 52, two vertical columns 53, an adjusting block 54, an upper switch 55, and a lower switch 56. The adjusting seat 51 includes a sidewall 511, an upper wall 512, and a lower wall 513. The adjusting seat 51 further includes a hollow portion 514 at a central portion thereof. The two guiding posts 52 are disposed on two sides of an upper end of the adjusting seat 51 and respectively press against and guide the first transmission printing sheet 81. The two vertical columns 53 are mounted between the upper wall 512 and the lower wall 513. Each of two sides of the adjusting block 54 includes a through-hole 541 through which one of the two vertical columns 53 extends. The adjusting block 54 further includes a horizontal rod 542 at a central portion thereof. The horizontal rod 542 abuts against the first transmission printing sheet 81. The first transmission printing sheet 81 is wound around a lower edge of the horizontal rod 542. The adjusting block 54 is movable on the two vertical columns 53 in the vertical direction and includes a touch rod 543. The upper switch 55 and the lower switch 56 are respectively disposed to upper and lower portions of the adjusting seat 51 and are electrically connected to the transmission device 41 of the operating unit 4. When the touch rod 543 comes in contact with the upper switch 55, the transmission device 41 of the operating unit 4 stops. When the touch rod 543 comes in contact with the lower switch 56, the transmission device 41 of the operating unit 4 starts to operate.

The sheet changing unit 6 is mounted to a side of the first and second discs 31 and 32 and includes a sheet changing seat 61, a lower horizontal beam 62, an upper horizontal beam 63, an actuation cylinder 64, a first sensor 65, and a second sensor 66. The lower horizontal beam 62 is mounted below the sheet changing seat 61. The upper horizontal beam 63 is mounted above the sheet changing seat 61 and is aligned with the lower horizontal beam 62. The actuation cylinder 64 is mounted above the sheet changing seat 61 and is configured to move the upper horizontal beam 63 in the vertical direction. The first and second sensors 65 and 66 can be infrared sensors or other suitable sensors. The first and second sensors 65 and 66 are disposed in association with the first and second discs 31, 32, respectively, are electrically connected to the actuation cylinder 64, and are configured to detect whether the first and second transmission printing sheets 81, 82 are running out. The first transmission printing sheet 81 extends between the upper and lower horizontal beams 62 and 63 and is guided by the guiding unit 3 to the thermal press printing unit 2. The second transmission printing sheet 82 on the second rotary disc 32 includes an end bonded to the lower horizontal beam 62 by a glue 822 with a relatively smaller bonding force. Another glue 823 with a relatively larger bonding force is applied to an upper side of the second transmission printing sheet 82.

The control unit 7 is electrically connected to the delivery unit 1, the thermal press printing unit 2, the guiding unit 3, and the operating unit 4. The control unit 7 can control or adjust the transmission device 13 of the delivery unit 1, the first and second heating devices 22 and 252 of the thermal press printing unit 2, the first and second lift cylinders 21 and 251, the transmission devices 312 and 322 of the guiding unit 3, and the transmission device 41 of the operating unit 4.

Figure 4:
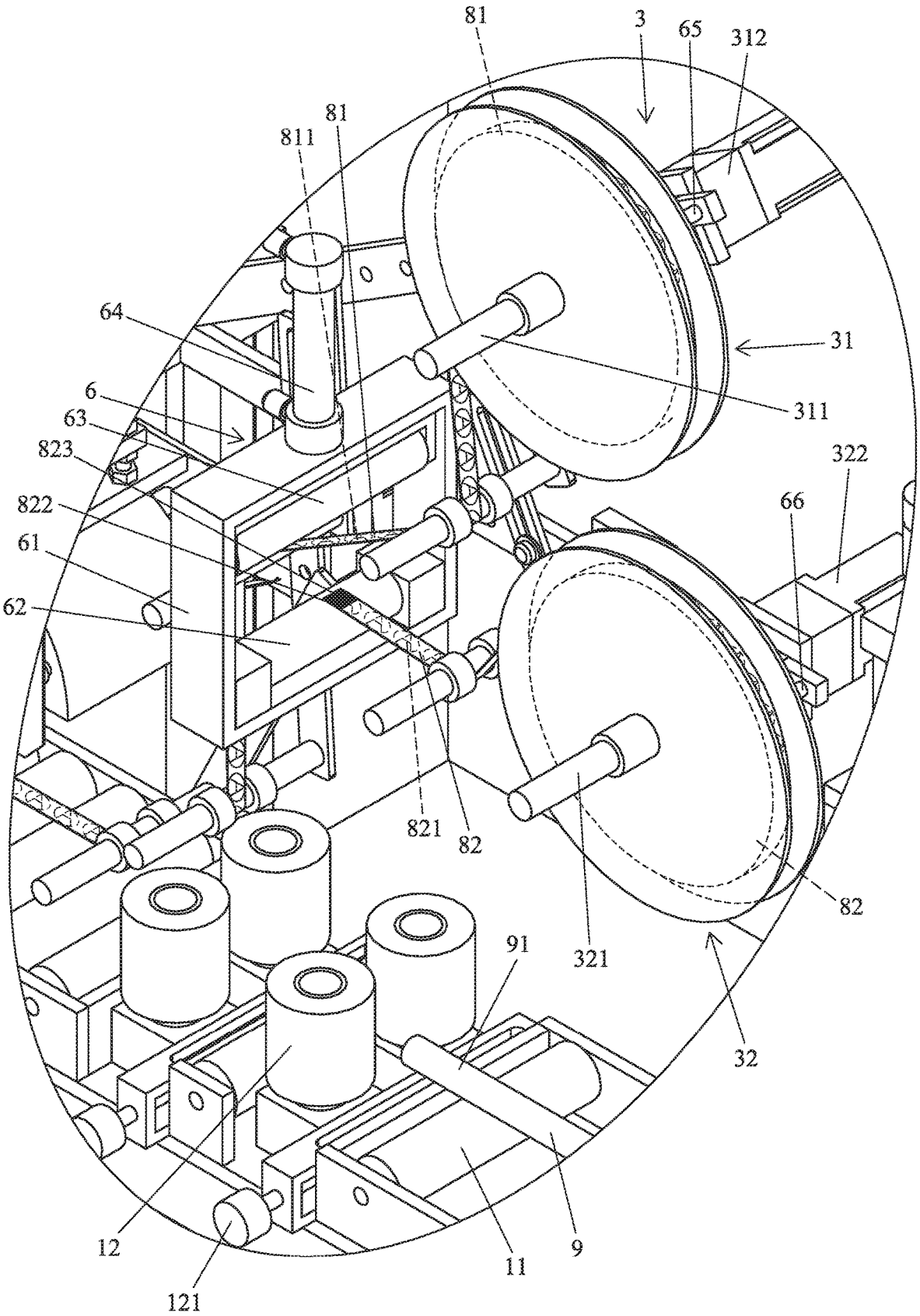
FIG. 4 is an enlarged, perspective view of another portion of the tube marking apparatus of FIG. 1.
Figure 5:
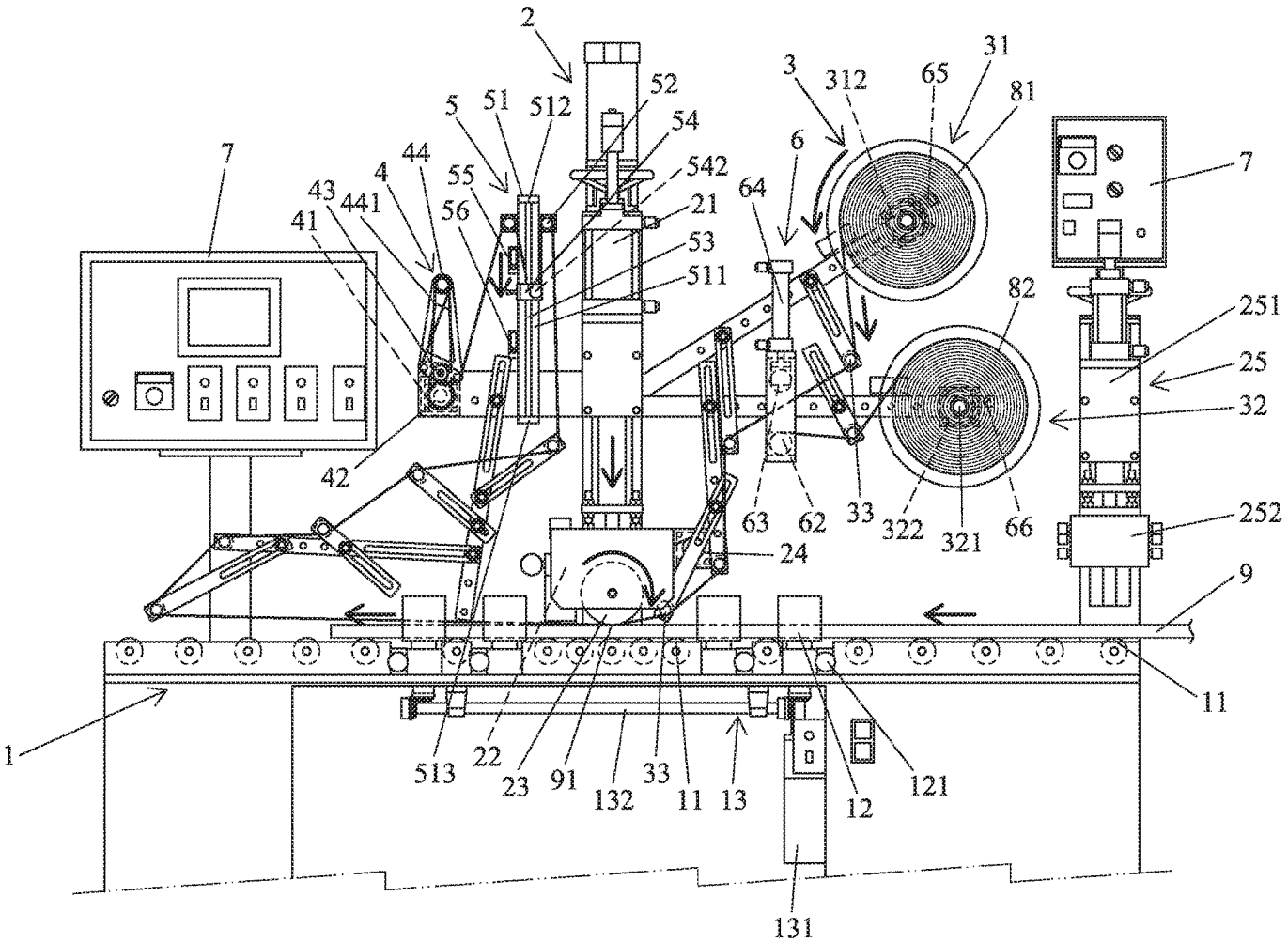
FIG. 5 is a diagrammatic elevational view illustrating operation of the tube marking apparatus of FIG. 1.

With reference to FIGS. 4 and 5, in practice, the first transmission printing sheet 81 is mounted to the first rotary disc 31, extends through the upper and lower horizontal beams 63 and 62, and abuts against each of the plurality of guiding rods 33 to a position above the delivery unit 1. Then, the first transmission printing sheet 81 extends below the adjusting block 54 of the adjusting unit 5 and between the operating rod 42 and the pressing rod 43, and an end of the first transmission printing sheet 81 couples with the recycling rod 44. An end of the second transmission printing sheet 82 on the second rotary disc 32 is bonded by the glue 822 with a relatively smaller bonding force to an upper side of the lower horizontal beam 62. The glue 823 with a relatively larger bonding force is applied on the upper side of the end of the second transmission printing seat 82.

Figure 10:
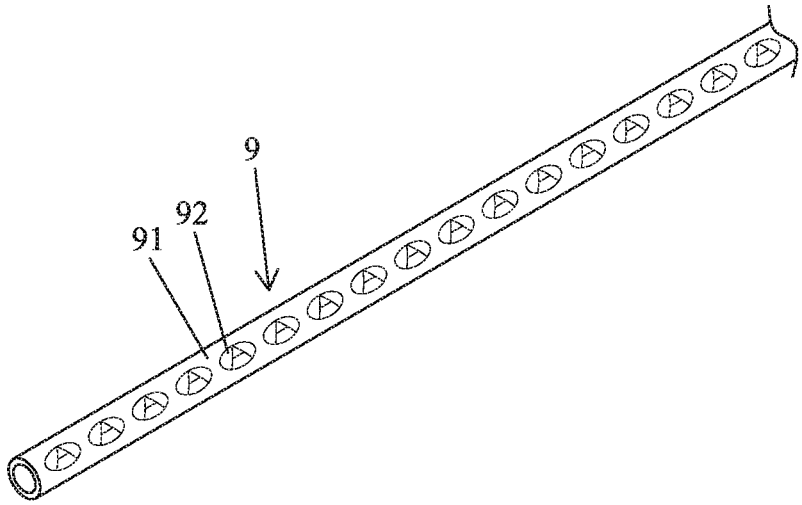
FIG. 10 is a diagrammatic perspective view of a tube marked by the tube marking apparatus of FIG. 1.

The spacing between each pair of operating rollers 12 of the delivery unit 1 is adjusted by the associated adjusting rod 121 in response to the diameter of the tube 9. The transmission device 13 of the delivery unit 1 is controlled by the control unit 7 to rotate the plurality of operating rollers 12. The first lift cylinder 21 of the thermal press printing unit 2 is moved downwards. The first heating device 22 provides heat. The transmission device 24 drives the press printing roller 23 to rotate. In a case that the tube 9 has a larger diameter, the second lift cylinder 251 of the preheating device 25 moves downwards, and the second heating device 252 provides heat. The tube 9 is placed on the plurality of supporting rollers 11, and an end of the tube 9 is disposed between a pair of operating rollers 12. In this case, the tube 9 can be delivered. Furthermore, the transmission device 41 of the operating unit 4 rotates the operating rod 42 and the recycling rod 44 and moves the first transmission printing sheet 81. Thus, the tube 9 and the first transmission printing sheet 81 are heated at locations corresponding to the press printing roller 23, and at least one mark 811 on the first transmission printing sheet 81 is transmissionred and printed onto an outer periphery 91 of the tube 9. The tube 9 is guided to leave the delivery unit 1, and the marks 81 on the first transmission printing sheet 81 can be transmissionred onto the outer periphery 91 of the tube 9 (and become marks 92 on the outer periphery 91 of the tube 9, as shown in FIG. 10). Two adjacent marks 92 are continuous to each other or have a spacing therebetween smaller than 50 cm. Thus, when the tube 9 is cut into a plurality of shorter tubes, each shorter tube can have at least one mark 92 as long as the length of each shorter tube is longer than 50 cm, providing a reliable anti-counterfeiting effect.

Figure 6:
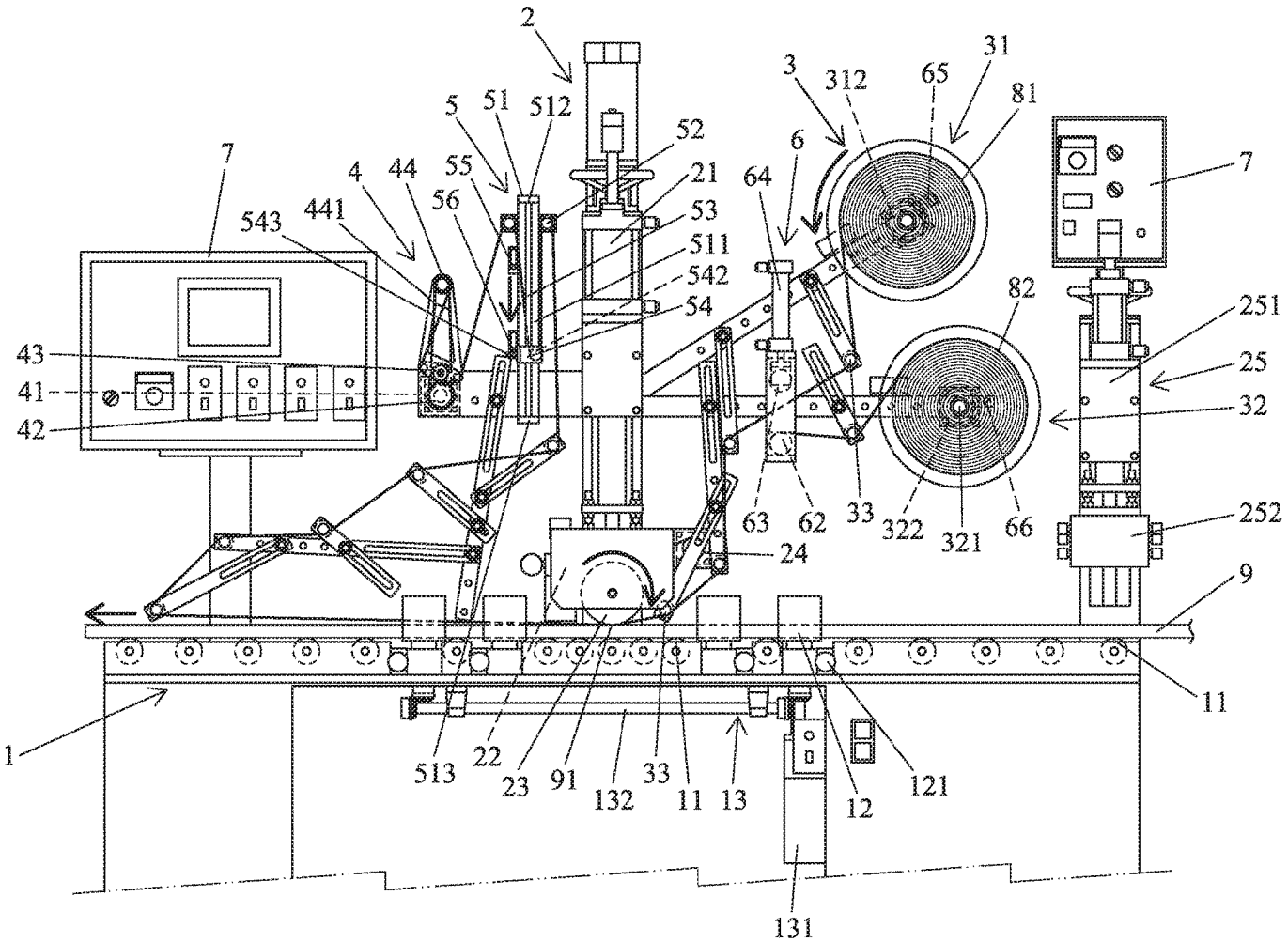
FIG. 6 is a view similar to FIG. 5 with an actuating block contacting with a lower switch.
Figure 7:
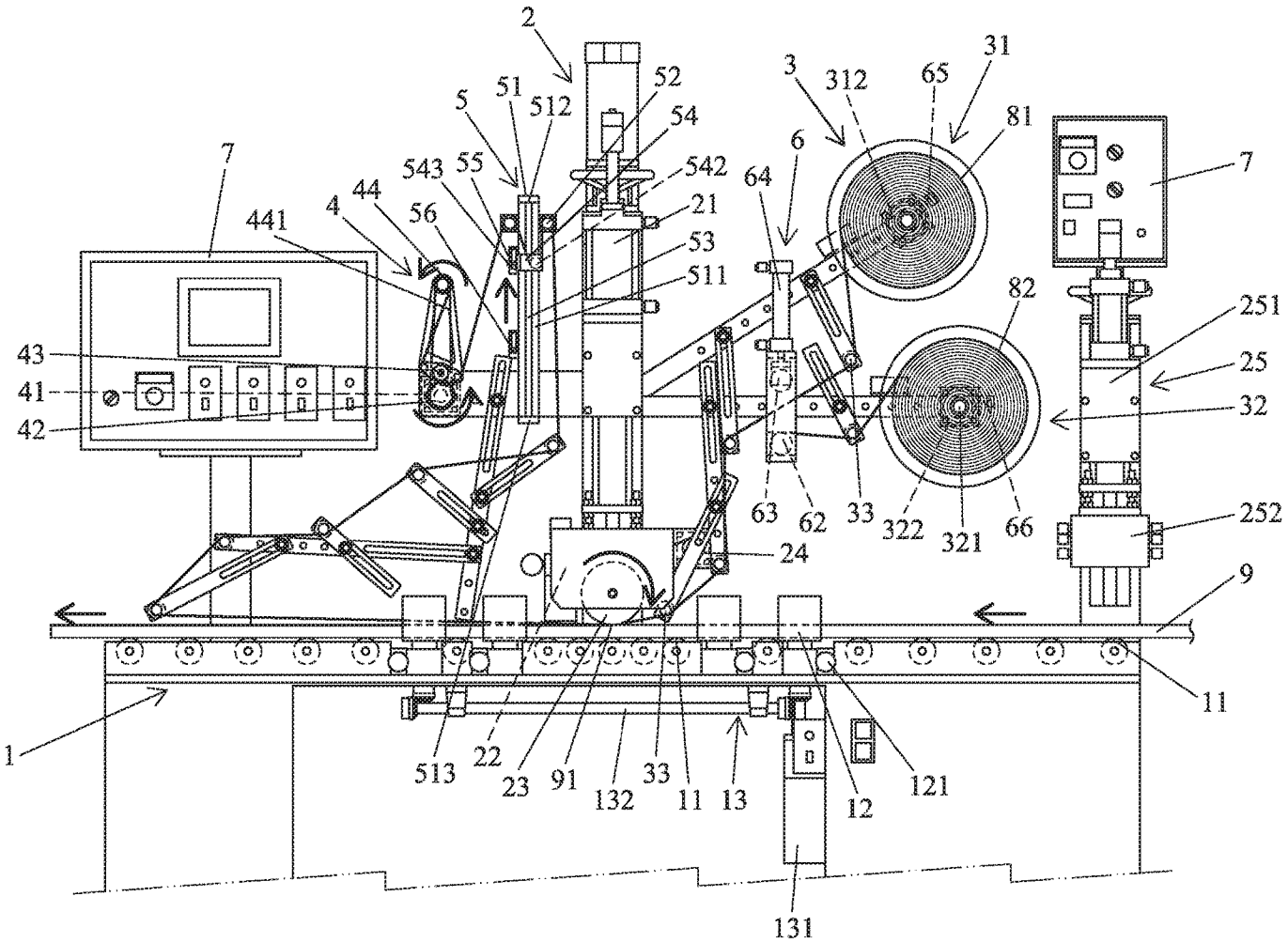
FIG. 7 is a view similar to FIG. 5 with the actuating block contacting with an upper switch.

With reference to FIGS. 3 and 5-7, in use, the transmission devices 312 and 322 of the first and second rotary discs 31 and 32 provide suitable torques for pulling the first and second transmission printing sheet 81 and 82. The weight of the adjusting block 54 of the adjusting unit 5 tightly pulls the first transmission printing sheet 81 to provide a smooth printing operation. With reference to FIG. 6, when the adjusting block 54 moves downwards to a position where the touch rod 543 contacts with the lower switch 56, the operating rod 42 of the operating unit 4 rotates, and the first transmission printing sheet 81 displaces to move the adjusting block 54 upwards, as shown in FIG. 7. When the touch rod 543 contacts with the upper switch 55, the operating rod 42 of the operating unit 4 stops. Thus, setting of the tension of the first transmission printing sheet 81 can be assured to provide reliable operational stability.

Figure 8:
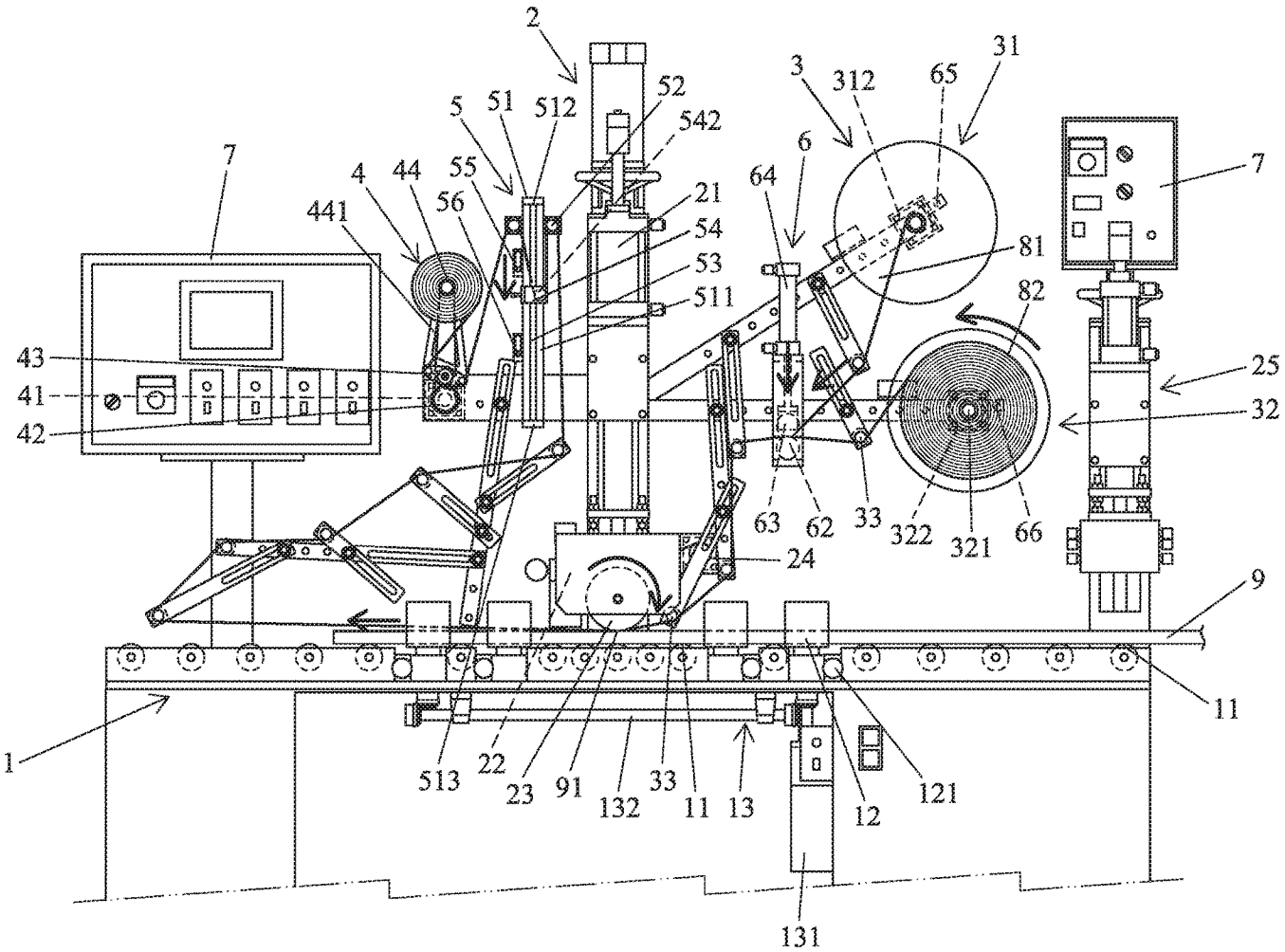
FIG. 8 is a view similar to FIG. 2, illustrating operation of a sheet changing unit.
Figure 9:
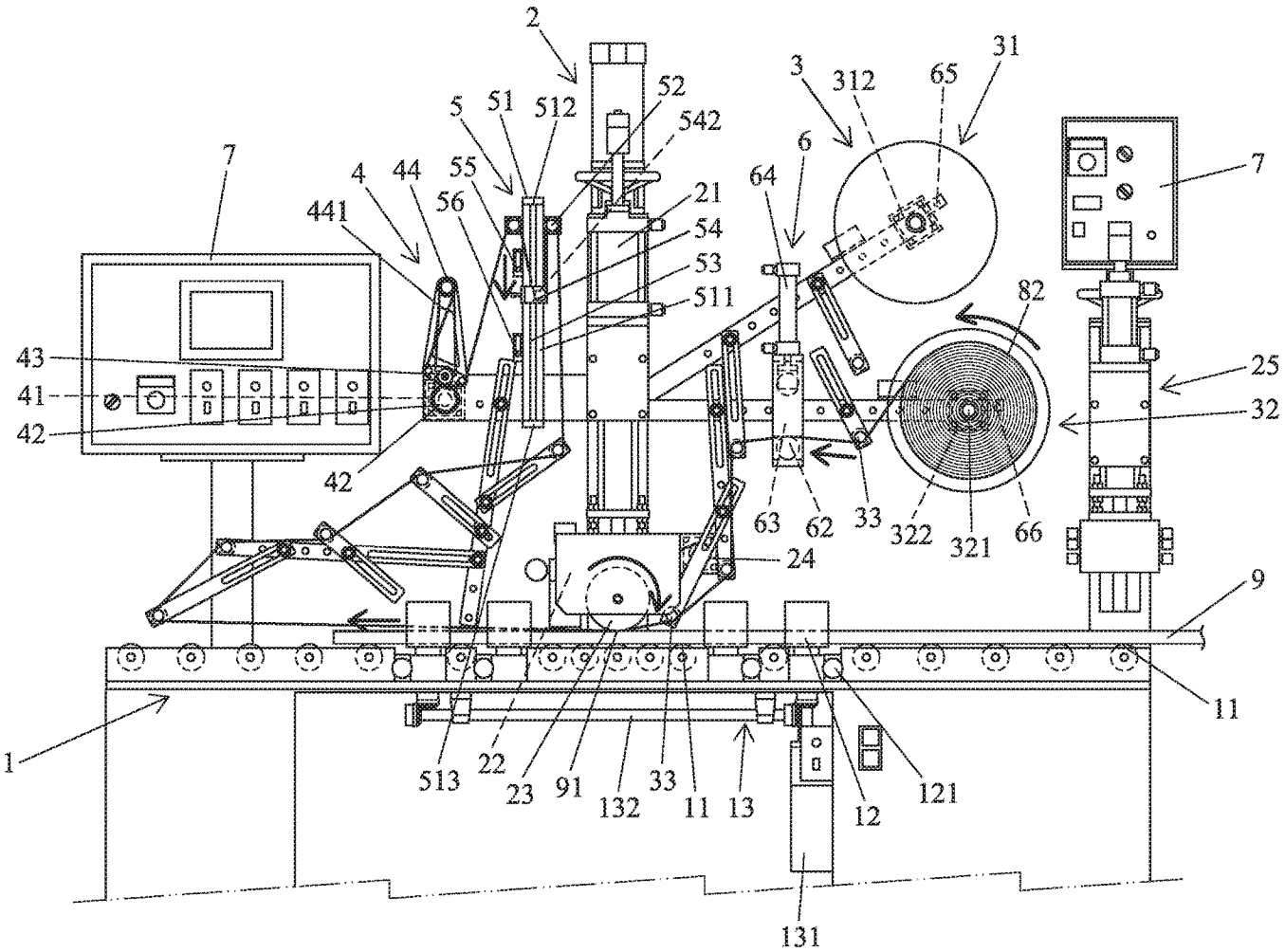
FIG. 9 is a view similar to FIG. 2, illustrating transmission printing of a transmission printing sheet of a second rotary disc.

With reference to FIGS. 4, 8, and 9, when the first detector 65 detects that the first transmission printing sheet 81 is about to run out, the actuation cylinder 64 of the sheet changing unit 6 is actuated to move the upper horizontal beam 63 downwards. Furthermore, the first transmission printing sheet 81 on the first rotary disc 31 is lowered to bond with the end of the second transmission printing sheet 82. Next, the upper horizontal beam 63 moves upwards, and the transmission printing operation is switched to the second transmission printing sheet 82 while the first transmission printing sheet 81 is recycled onto the recycling rod 44.

Another first transmission printing sheet 81 can be mounted to the first rotary disc 31, and an end of the another first transmission printing sheet 81 can be disposed on the lower horizontal beam 62 in a manner described above. When the second sensor 66 detects that the second transmission printing sheet 82 is about to run out, the actuation cylinder 64 is actuated to permit use of the another first transmission printing sheet 81 for continuous transmission printing operation. Thus, the transmission printing operation can continue for a long period of time to improve the operating efficiency.

With reference to FIG. 10, the outer periphery 91 of the tube 9 marked by the tube marking apparatus according to the present invention includes a plurality of marks 92. Two adjacent marks 92 are continuous to each other or have a spacing therebetween smaller than 50 cm. Thus, when the tube 9 is cut into a plurality of shorter tubes, each shorter tube can have at least one mark 92 as long as the length of each shorter tube is longer than 50 cm, providing a better marking effect and a better anti-counterfeiting effect.

In view of the foregoing, the tube marking apparatus according to the present invention provides a clear marking effect and an anti-counterfeiting effect for shorter tubes purchased by customers after cutting. Furthermore, the tube marking apparatus according to the present invention provides a rapid tube marking operation. Furthermore, the tube marking apparatus can include only one rotary disc and does not have to include the preheating device 25.

Although specific embodiments have been illustrated and described, numerous modifications and variations are still possible without departing from the scope of the invention. The scope of the invention is limited by the accompanying claims.

The invention claimed is:

1. A tube marking apparatus comprising:

a delivery unit including a plurality of supporting rollers and a plurality of operating rollers configured to deliver a tube;

a thermal press printing unit mounted above the delivery unit and including a first lift cylinder, a first heating device, and a press printing roller, wherein the first heating device and the press printing roller are actuated by the first lift cylinder to move in a vertical direction;

a guiding unit including a first rotary disc and a plurality of guiding rods, wherein a first transmission printing sheet is mounted to the first rotary disc and carries a plurality of marks thereon, wherein two adjacent marks are continuous to each other or have a spacing therebetween smaller than 50 cm;

an operating unit for moving the first transmission printing sheet; and a control unit electrically connected to the delivery unit, the thermal press printing unit, the guiding unit, and the operating unit, wherein the delivery unit and the operating unit respectively move the tube and the first transmission printing sheet, and the thermal press printing unit transmissions the plurality of marks of the first transmission printing sheet onto an outer periphery of the tube.

2. The tube marking apparatus as claimed in claim 1, wherein the plurality of supporting rollers of the delivery unit is coplanarly disposed for supporting the tube, wherein the plurality of operating rollers is arranged in pairs and is disposed above and spaced from the plurality of supporting rollers, wherein each pair of operating rollers is provided with an adjusting rod to adjust a spacing therebetween, wherein the delivery unit includes a transmission device having a motor and a transmission rod coupled with the motor and the plurality of operating rollers, and wherein the motor drives the transmission rod and the plurality of operating rollers to rotate and to move the tube.

3. The tube marking apparatus as claimed in claim 1, wherein the thermal press printing unit further includes a preheating device and a transmission device for rotating the press printing roller, wherein the preheating device preheats the tube and is mounted above the plurality of supporting rollers, and wherein the preheating device includes a second lift cylinder and a second heating device movable by the second lift cylinder.

4. The tube marking apparatus as claimed in claim 1, wherein the guiding unit further includes a second disc, wherein a second transmission printing sheet with a plurality of marks is mounted to the second disc, wherein two adjacent marks on the second transmission printing sheet are continuous to each other or have a spacing therebetween smaller than 50 cm, wherein the first disc includes a first shaft connected to a transmission device, and wherein the second disc includes a second shaft connected to another transmission device.

5. The tube marking apparatus as claimed in claim 1, wherein the operating unit includes a transmission device, an operating rod, a pressing rod, and a recycling rod, wherein the transmission device of the operating unit rotates the operating rod, wherein the pressing rod is mounted to a side of the operating rod, wherein the first transmission printing sheet is clamped between the operating rod and the pressing rod, and wherein the recycling rod interlocks with the operating rod and is coupled to an end of the first transmission printing sheet.

6. The tube marking apparatus as claimed in claim 5, further comprising an adjusting unit mounted to an input side of the operating unit and including an adjusting seat, two guiding posts, two vertical columns, an adjusting block, an upper switch, and a lower switch, wherein the adjusting seat includes a sidewall, an upper wall, and a lower wall, wherein the adjusting seat further includes a hollow portion at a central portion thereof, wherein the two guiding posts are disposed on two sides of an upper end of the adjusting seat and respectively press against and guide the first transmission printing sheet, wherein the two vertical columns are mounted between the upper wall and the lower wall, wherein each of two sides of the adjusting block includes a through-hole through which one of the two vertical columns extends, wherein the adjusting block further includes a horizontal rod located at a central portion thereof and abutting against the first transmission printing sheet, wherein the first transmission printing sheet is wound around a lower edge of the horizontal rod, wherein the adjusting block is movable on the two vertical columns in the vertical direction and includes a touch rod configured to selectively abut against one of the upper switch and the lower switch, wherein the upper switch and the lower switch are respectively disposed to upper and lower portions of the adjusting seat and are electrically connected to the transmission device of the operating unit, and wherein the operating rod rotates at a first rotating speed slightly faster than a second rotating speed of the plurality of operating rollers of the delivery unit.

7. The tube marking apparatus as claimed in claim 4, further comprising a sheet changing unit mounted to a side of the first and second discs, wherein the sheet changing unit includes a sheet changing seat, a lower horizontal beam, an upper horizontal beam, an actuation cylinder, a first sensor, and a second sensor, wherein the lower horizontal beam is mounted below the sheet changing seat, wherein the upper horizontal beam is mounted above and aligned with the lower horizontal beam, wherein the actuation cylinder is mounted above the sheet changing seat and is configured to move the upper horizontal beam in the vertical direction, wherein the first and second sensors are disposed in association with the first and second discs, respectively, are electrically connected to the actuation cylinder, and are configured to detect whether the first and second transmission printing sheets are about to run out.

8. The tube marking apparatus as claimed in claim 7, wherein the first transmission printing sheet extends between the upper and lower horizontal beams and is guided by the guiding member to the thermal press printing unit, wherein the second transmission printing sheet includes an end bonded to the lower horizontal beam by a glue with a relatively smaller bonding force, and wherein another glue with a relatively larger bonding force is applied to an upper side of the end of the second transmission printing sheet.

* * * * *